US008981657B2

(12) United States Patent
Su et al.

(10) Patent No.: US 8,981,657 B2
(45) Date of Patent: Mar. 17, 2015

(54) CIRCUITS AND METHODS FOR DRIVING LIGHT SOURCES

(71) Applicant: O2Micro, Inc., Santa Clara, CA (US)

(72) Inventors: Xinhe Su, Sichuan (CN); Xiang Geng, Sichuan (CN)

(73) Assignee: O2Micro, Inc., Santa Clara, CA (US)

( * ) Notice: Subject to any disclaimer, the term of this patent is extended or adjusted under 35 U.S.C. 154(b) by 197 days.

(21) Appl. No.: 13/851,681

(22) Filed: Mar. 27, 2013

(65) Prior Publication Data

US 2014/0265907 A1 Sep. 18, 2014

(51) Int. Cl.
*H05B 33/08* (2006.01)

(52) U.S. Cl.
CPC ..... *H05B 33/0815* (2013.01)
USPC ..... 315/224

(58) Field of Classification Search
CPC ..... H05B 33/0815
USPC ..... 315/224
See application file for complete search history.

(56) References Cited

U.S. PATENT DOCUMENTS 7,378,805 B2 * 5/2008 Oh et al. ..... 315/291
7,577,002 B2 * 8/2009 Yang ..... 363/1
2011/0140630 A1 * 6/2011 Doudousakis et al. ..... 315/291

OTHER PUBLICATIONS

"Reduction of Power Supply EMI Emission by Switching Frequency Modulation", IEEE Transactions on Power Electronics, vol. 9, No. 1, Jan. 1994, by Feng Lin, Member, IEEE, and Dan Y. Chen, Senior Member, IEEE (132 pages).

* cited by examiner

*Primary Examiner* — Douglas W Owens
*Assistant Examiner* — Pedro C Fernandez

(57) ABSTRACT

A circuit for powering a LED light source includes a converter and a controller. The converter provides an output voltage, and includes a first switch which is turned on and off alternately according to a driving signal to control a current. The controller generates the driving signal which is a periodic signal having a first state and a second state per time period. The first switch is turned on when the driving signal operates in the first state, and is turned off when the driving signal operates in the second state. The controller modulates a time period of the driving signal and a time duration of the first state, such that a quotient of the time duration squared and the time period is substantially independent of a change of the time period, and the current is substantially independent of the change.

26 Claims, 10 Drawing Sheets

CIRCUITS AND METHODS FOR DRIVING LIGHT SOURCES

RELATED APPLICATION

This application claims priority to Chinese Patent Application No. 201310080780.0, titled "Circuits and Methods for Driving Light Sources," filed on Mar. 14, 2013, with the State Intellectual Property Office of the People's Republic of China, which is incorporated by reference.

BACKGROUND

Electromagnetic interference (EMI) is a disturbance that interrupts, obstructs, or otherwise degrades or limits the effective performance of a circuit. Electromagnetic compatibility (EMC) is intended to ensure that circuits will not interfere with or prevent each other's operation because of EMI absorption.

A driving circuit for a light-emitting diode (LED) light source usually includes a converter for receiving an alternating-current input voltage from the grid and for generating a direct-current output voltage to drive the LED source. The converter turns a switch on and off according to a pulse-width-modulation (PWM) signal, such that the LED source is powered and the dimming controlled. However, because of the on and off operation of the switch, the current through the LED source is periodic and non-sinusoidal, composed of a sinusoidal current of a fundamental frequency and multiple sinusoidal currents of harmonic frequencies in a spectrum analysis. A harmonic frequency is an integral multiple of a fundamental frequency, for example, the secondary harmonic frequency of a fundamental frequency 50 Hz is 100 Hz, and the third harmonic frequency is 150 Hz. Thus, the current flowing through the LED source may further comprise a secondary harmonic, a third harmonic, and even more upper-harmonics. By either electromagnetic induction or radiation, the harmonic currents will enter other light-current systems (such as video systems or audio systems) in the same grid and interrupt their operations. Therefore, a conventional driving circuit for the LED light source has relatively poor EMC.

Switching frequency modulation is a conventional method to reduce EMI (see "Reduction of Power Supply EMI Emission by Switching Frequency Modulation", IEEE Transactions on Power Electronics, Vol. 9, No. 1, January 1994, by Feng Lin, Member, IEEE, and Dan Y. Chen, Senior Member, IEEE). The converter creates side-bands by modulating the switching frequency, and thus the radiation characteristics of the harmonic currents are converted from a narrow-band noise to a broad-band noise. For example, by modulating the switching frequency in a preset range regularly or randomly, the noise energy is distributed into smaller pieces scattered around side-band frequencies, such that a peak current at the harmonic frequency is attenuated effectively. Thus, EMI is reduced. However, the LED current changes as the switching frequency changes, which will cause the LED light source to flicker. Therefore, the LED light source has poor current stability.

SUMMARY

Embodiments according to the present invention provide a driving circuit for powering a LED light source. The circuit includes a converter and a controller. The converter provides an output voltage to power the light source. The converter includes a first switch which is turned on and off according to a driving signal to control a current through the light source.

The controller generates the driving signal, which is a periodic signal having a first state and a second state per time period (that is, each time period equals the length of time the driving signal is in the first state plus the length of time the driving signal is in the second state). The first switch is turned on when the driving signal operates in the first state, and is turned off when the driving signal operates in the second state. The controller modulates the time period of the driving signal and a time duration of the first state, such that a quotient of the square of the time duration and the time period is substantially independent of a change of the time period (that is, a change in the length of time period) from one time period to another, and the current is substantially independent of the change.

Embodiments according to the present invention also provide a controller for controlling power to a LED light source. The controller includes a ramp generator and an output circuit. The ramp generator generates a ramp signal which ramps up and down periodically. The output circuit generates a driving signal according to the ramp signal. A first switch coupled to the controller is turned on and off according to the driving signal to regulate a current through the light source. The driving signal is a periodic signal having a first state and a second state per time period. The first switch is turned on when the driving signal operates in the first state, and is turned off when the driving signal operates in the second state. The controller regulates a rising rate and a falling rate of the ramp signal to modulate the time period of the driving signal and a time duration of the first state, such that a quotient of the square of the time duration and the time period is substantially independent of a change of the time period from one time period to another, and the current is substantially independent of the change.

Embodiments according to the present invention also provide a method for controlling power to a LED light source. The method includes: converting an input voltage to an output voltage based on a conductance status of a first switch to power the light source; generating a driving signal to operate the first switch on and off to control a current through the light source, where the driving signal is a periodic signal having a first state and a second state per time period, where the first switch is turned on when the driving signal operates in the first state, and is turned off when the driving signal operates in the second state; modulating the time period of the driving signal and a time duration of the first state, such that a quotient of the square of the time duration and the time period is substantially independent of a change of the time period from one time period to another, and the current is substantially independent of the change.

BRIEF DESCRIPTION OF THE DRAWINGS

Features and advantages of embodiments of the claimed subject matter will become apparent as the following detailed description proceeds, and upon reference to the drawings, wherein like numerals depict like parts, and in which:

DETAILED DESCRIPTION

Reference will now be made in detail to the embodiments of the present invention. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

Embodiments in accordance with the present invention pertain to circuits and methods for powering a light source. In one embodiment, a circuit for powering a LED light source includes a converter and a controller. The converter provides an output voltage to power the light source. The converter includes a first switch which is turned on and off according to a driving signal to control a current through the light source. The controller generates the driving signal, which is a periodic signal having a first state and a second state in a time period. That is, in each time period, the periodic signal experiences a single first state and a single second state, such that the time period is equal in length to the sum of the length of time the periodic signal is in the first state and the length of time the periodic signal is in the second state. The first switch is turned on when the driving signal operates in the first state, and is turned off when the driving signal operates in the second state. The controller modulates time periods of the driving signal and time durations of the first state, such that a quotient of the square of a time duration and a time period is substantially independent of a change to the length of the time period of the driving signal from one time period to another, and such that the current is substantially independent of the change. Advantageously, the switching frequency of the first switch is modulated as the time period changes. The controller further sets the change rates of the time duration and of the time period, such that a quotient of the square of the time duration and the time period is substantially independent of a period change, and the current flowing through the light source is further independent of a period change. Therefore, EMC and stability of the driving circuit are both enhanced.

Figure 1A:
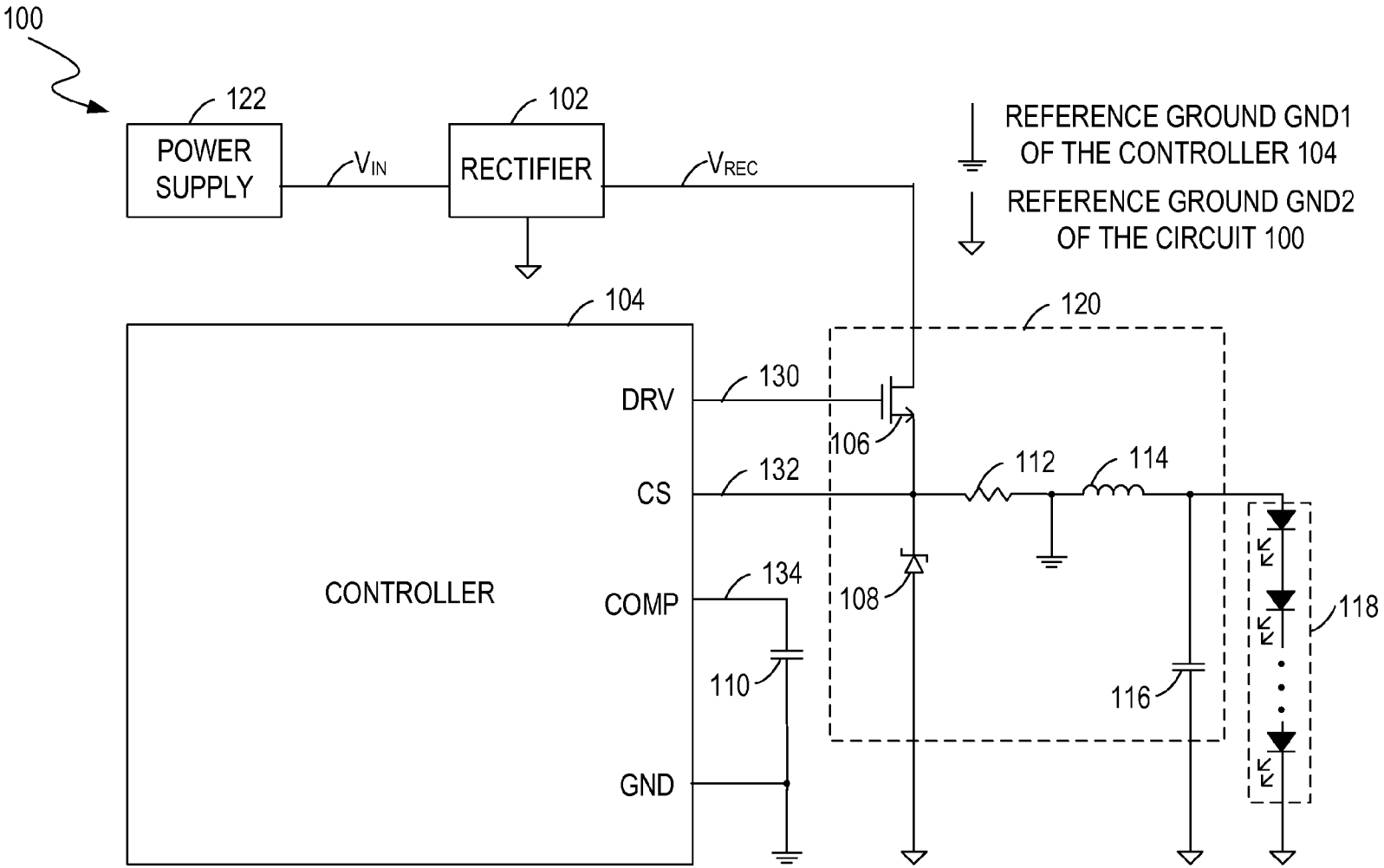
FIG. 1A illustrates a diagram of a driving circuit, in an embodiment according to the present invention.

FIG. 1A illustrates a block diagram of a driving circuit 100, in an embodiment according to the present invention. In the embodiment of FIG. 1A, the driving circuit 100 includes a power supply 122, a rectifier 102, a controller 104, a converter 120, and a LED light source 118. The power supply 122 provides an input voltage $V_{IN}$ (e.g., an alternating sinusoidal voltage). The rectifier 102 rectifies the input voltage $V_{IN}$ to generate a rectified voltage $V_{REC}$. The converter 120 converts the rectified voltage $V_{REC}$ to an output voltage $V_{OUT}$ to power the LED light source 118. The controller 104 controls the converter 120 to control the current flowing through the LED light source 118.

As shown in FIG. 1A, the controller 104 includes a DRV pin, a CS pin, a COMP pin, and a GND pin. The converter 120 can be but is not limited to a buck converter, which includes a switch 106, a diode 108, a resistor 112, an energy storage unit 114 (e.g. an inductor), and a capacitor 116. The GND pin of the controller is coupled to a reference ground GND1 of the controller 104, and the COMP pin is coupled to the reference ground GND1 via a capacitor 110. In one embodiment, the resistor 112 senses the current flowing through the inductor 114, and generates a sense signal 132 indicating the current flowing through the LED light source 118, accordingly. The controller 104 receives the sense signal 132 via the CS pin and generates a driving signal 130 according to the sense signal 132. The controller 104 provides the driving signal 130 via the DRV pin to the switch 106 in the converter 120. In one embodiment, the switch 106 is turned on and off according to the driving signal 130, such that the current flowing through the inductor 114 is regulated and the current flowing through the LED light source 118 is further regulated.

In one embodiment, the driving signal 130 is a PWM signal with a time period of $T_{SW}$. The driving signal 130 has a first level (e.g., a high electrical level) and a second level (e.g., a low electrical level) per period. When the driving signal 130 has the first level, the switch 106 is turned on. A current $I_L$ then flows through the switch 106, the resistor 112, and the inductor 114, so as to charge the inductor 114. The current $I_L$ increases gradually. The growth $I_{L,UP}$ of the current $I_L$ can be given by the equation (1):

$$I_{L,UP}=(V_{REC}-V_{OUT})*T_{ON}/L, \tag{1}$$

where $T_{ON}$ represents a time duration when the driving signal 130 has the first level, and L represents the inductance of the inductor 114. When the driving signal 130 has the second level, the switch is turned off. The current $I_L$ then flows through the diode 108, the resistor 112, and the inductor 114, so as to discharge the inductor 114. The current $I_L$ decreases gradually. The reduction $I_{L,DOWN}$ of the current $I_L$ can be given by the equation (2):

$$I_{L,DOWN}=-V_{OUT}*T_{DOWN}/L, \tag{2}$$

where $T_{DOWN}$ represents a time duration for the current $I_L$ to drop to zero amperes when the driving signal 130 has the second level. Since the net current of the growth $I_{L,UP}$ and the reduction $I_{L,DOWN}$ is zero ($I_{L,UP}+I_{L,DOWN}=0$), the relationship between $T_{ON}$ and $T_{DOWN}$ of the current $I_L$ can be given by the equation (3):

$$T_{DOWN}=(V_{REC}-V_{OUT})/V_{OUT}*T_{ON}. \tag{3}$$

Thus, it can be further given by the equation (4):

$$T_{ON}+T_{DOWN}=V_{REC}/V_{OUT}*T_{ON}. \tag{4}$$

The capacitor 116 filters a ripple of the current $I_L$ flowing through the inductor 114. Therefore, the current flowing through the LED light source 118 is substantially equal to an average current $I_{L,A}$ of the current $I_L$.

Figure 1B:
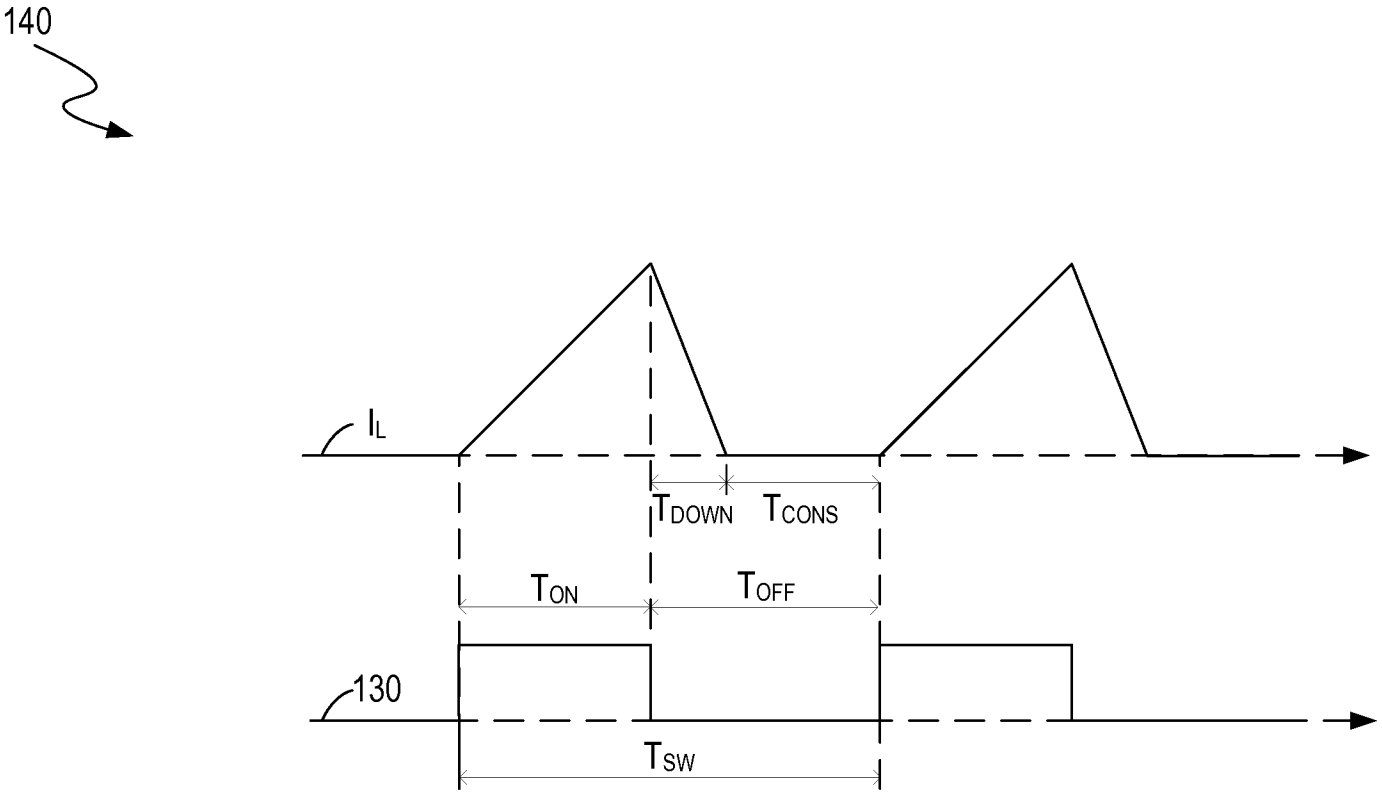
FIG. 1B illustrates waveforms of signals received or generated by a converter, in an embodiment according to the present invention.

FIG. 1B illustrates waveforms 140 of signals received or generated by a converter (e.g., the converter 120), in an embodiment according to the present invention. FIG. 1B is described in combination with FIG. 1A. In one embodiment, the converter 120 operates in a discontinuous conduction mode. FIG. 1B shows the driving signal 130 and the current $I_L$ when the converter operates in a discontinuous conduction mode.

As shown in FIG. 1B, the time period $T_{SW}$ of the driving signal 130 includes a time duration $T_{ON}$ and a time duration $T_{OFF}$. During the time duration $T_{ON}$, the driving signal 130 has a high electrical level, and the current $I_L$ increases. During the time duration $T_{OFF}$, the driving signal 130 has a low electrical level. The time duration $T_{OFF}$ further includes a fall time $T_{DOWN}$ and a constant time $T_{CONS}$. During the fall time $T_{DOWN}$, the current $I_L$ decreases. During the constant time $T_{CONS}$, the current $I_L$ drops to zero amperes, and the current level is maintained at zero, until the driving signal 130 is switched to a high electrical level again (representing entering the next period). Thus, the time period $T_{SW}$ is greater than the sum of time duration $T_{ON}$ and the fall time $T_{DOWN}$.

According to the waveform of the current $I_L$ as shown in FIG. 1B, the average current $I_{L,A}$ flowing through the LED light source 118 can be given by the equation (5):

$$I_{L,A}=\tfrac{1}{2}*(I_{L,UP}*T_{ON}+|I_{L,DOWN}|*T_{DOWN})/T_{SW}. \tag{5}$$

Based on equation (2), (4), and (5), the average current $I_{L,A}$ can be further given by the equation (6):

$$\begin{aligned} I_{L,A} &= 1/2*I_{L,UP}^{*}(T_{ON}+T_{DOWN})/T_{SW} \\ &= 1/(2L)*(V_{REC}-V_{OUT})*T_{ON}*(T_{ON}+T_{DOWN})/T_{SW} \\ &= 1/(2L)*(V_{REC}-V_{OUT})*T_{ON}^{2}/T_{SW}^{*}(V_{REC}/V_{OUT}). \end{aligned} \tag{6}$$

Therefore, the average current $I_{L,A}$ flowing through the light source 118 is a function of a quotient of the square of the time duration $T_{ON}$ and the time period $T_{SW}$ ($T_{ON}^2/T_{SW}$).

The controller 104 modulates the time period $T_{SW}$ and the time duration $T_{ON}$ of the driving signal 130. In other words, the length of the time period $T_{SW}$ is randomly or regularly changed within a preset range in different periods of the driving signal 130. By way of example, when the driving circuit 100 is powered and activated, the driving signal 130 operates with a first time period of length $T_{SW1}$, a second time period of length $T_{SW2}$, a third time period of length $T_{SW3}$, a fourth time period of length $T_{SW4}$, and subsequent time periods (e.g., time periods having lengths of $T_{SW6}$-$T_{SW10}$). If the maximum change rate of the length of the time period $T_{SW1}$ is set to 10%, the change rates of the lengths of the time periods $T_{SW2}$, $T_{SW3}$, $T_{SW4}$, and subsequent time periods relative to $T_{SW1}$ are less than or equal to 10%. As illustrated in Table 1, $T_{SW1}$, $T_{SW2}$, $T_{SW3}$, $T_{SW4}$, $T_{SW5}$, $T_{SW6}$, $T_{SW7}$, $T_{SW8}$, $T_{SW9}$, and $T_{SW10}$ can be equal to $T_{SW,M}$, $1.01*T_{SW,M}$, $1.02*T_{SW,M}$, $1.03*T_{SW,M}$, $1.04*T_{SW,M}$, $1.05*T_{SW,M}$, $1.06*T_{SW,M}$, $1.07*T_{SW,M}$, $1.08*T_{SW,M}$, and $1.09*T_{SW,M}$, respectively, where $T_{SW,M}$ represents the length of a predetermined basic time period for the driving signal 130. In one embodiment, the time period $T_{SW}$ of the driving signal 130 is equal to the basic time period $T_{SW,M}$ when the driving circuit 100 is activated. In another embodiment, the time periods $T_{SW2}$, $T_{SW3}$, $T_{SW4}$, and subsequent time periods can be any random value satisfying a maximum change rate of 10%. For example, $T_{SW1}$, $T_{SW2}$, $T_{SW3}$, $T_{SW4}$, $T_{SW5}$, $T_{SW6}$, $T_{SW7}$, $T_{SW8}$, $T_{SW6}$, and $T_{SW10}$ can be equal to $T_{SW,M}$, $1.03*T_{SW,M}$, $1.07*T_{SW,M}$, $1.02*T_{SW,M}$, $1.05*T_{SW,M}$, $1.01*T_{SW,M}$, $1.03*T_{SW,M}$, $1.02*T_{SW,M}$, $1.08*T_{SW,M}$, and $1.06*T_{SW,M}$, respectively, as illustrated in Table 2.

TABLE 1

| | $T_{SW1}$ | $T_{SW2}$ | $T_{SW3}$ | $T_{SW4}$ | $T_{SW5}$ |
|---|---|---|---|---|---|
| period | $T_{SW,M}$ | $1.01*T_{SW,M}$ | $1.02*T_{SW,M}$ | $1.03*T_{SW,M}$ | $1.04*T_{SW,M}$ |
| rate | 0 | 1% | 2% | 3% | 4% |
| | $T_{SW6}$ | $T_{SW7}$ | $T_{SW8}$ | $T_{SW9}$ | $T_{SW10}$ |
| period | $1.05*T_{SW,M}$ | $1.06*T_{SW,M}$ | $1.07*T_{SW,M}$ | $1.08*T_{SW,M}$ | $1.09*T_{SW,M}$ |
| rate | 5% | 6% | 7% | 8% | 9% |

TABLE 2

| | $T_{SW1}$ | $T_{SW2}$ | $T_{SW3}$ | $T_{SW4}$ | $T_{SW5}$ |
|---|---|---|---|---|---|
| period | $T_{SW,M}$ | $1.03*T_{SW,M}$ | $1.07*T_{SW,M}$ | $1.02*T_{SW,M}$ | $1.05*T_{SW,M}$ |
| rate | 0 | 3% | 7% | 2% | 5% |
| | $T_{SW6}$ | $T_{SW7}$ | $T_{SW8}$ | $T_{SW9}$ | $T_{SW10}$ |
| period | $1.01*T_{SW,M}$ | $1.03*T_{SW,M}$ | $1.02*T_{SW,M}$ | $1.08*T_{SW,M}$ | $1.06*T_{SW,M}$ |
| rate | 1% | 3% | 2% | 8% | 6% |

Advantageously, the switching frequency of the switch 106 is modulated as the time period $T_{SW}$ changes. Since the noise energy of the current $I_L$ is distributed around side-band frequencies by switching frequency modulation, the noise energy of the current $I_L$ at certain harmonic frequencies is reduced relatively. Therefore, EMC of the driving circuit 100 is improved.

Advantageously, the controller 104 further sets the change rate of the time duration $T_{ON}$ and the change rate of the time period $T_{SW}$, such that a quotient of the time duration $T_{ON}$ squared and the time period $T_{SW}$ is substantially independent of the period change. According to the equation (6), the average current $I_{L,A}$ through the LED light source 118 is further independent of the period change. Therefore, flickering of the LED light source 118 is avoided and the stability of the driving circuit 100 is enhanced.

The change rate of the time duration $T_{ON}$ and the change rate of the time period $T_{OFF}$ are set as described below.

In one embodiment, the controller 104 controls the time period $T_{SW}$ to have a first change rate $\partial$, e.g., $T_{SW}=T_{SW,M}*(1+\partial)$, where $T_{SW,M}$ represents a predetermined basic time period for the driving signal 130. The controller 104 further controls the time duration $T_{ON}$ to have a second change rate $\beta$, e.g., $T_{ON}=T_{ON,M}*(1+\beta)$, where $T_{ON,M}$ represents a predetermined basic time duration for the driving signal 130 to be at the first level. In one embodiment, the driving signal 130 has the basic time period $T_{SW,M}$ and the basic time duration $T_{ON,M}$ when the driving circuit 100 is activated. In subsequent periods, the time period $T_{SW}$ and the time duration $T_{ON}$ are modulated relevant to the basic time period $T_{SW,M}$ and the basic time duration $T_{ON,M}$, respectively. Thus, $T_{ON}^2/T_{SW}$ can be given by the equation (7):

$$\begin{aligned} T_{ON}^{2}/T_{SW} &= [T_{ON,M}(1+\beta)]^{2}/[T_{SW,M}(1+\partial)] \\ &= T_{ON,M}^{2}/T_{SW,M}^{*}(1+2\beta+\beta^{2})/(1+\partial). \end{aligned} \tag{7}$$

According to the equation (7), the controller 104 sets the change rate $\partial$ and $\beta$ to satisfy $1+\partial=(1+\beta)^2=1+2\beta+\beta^2$. Then, quotients of the time duration $T_{ON}$ squared and the time period $T_{SW}$ in subsequent periods are equal to a quotient of the basic time duration $T_{ON,M}$ squared and the basic time period $T_{SW,M}$ in the basic period. In other words, when the controller 104 controls the first change rate ∂ of the time period $T_{SW}$ and the second change rate β of the time duration $T_{ON}$ to satisfy the relationship as shown in the equation (8), $T_{ON}^2/T_{SW}$ is independent of the period change:

$$\partial=2\beta+\beta^2. \tag{8}$$

Therefore, as long as the change rate ∂ and β satisfy the equation (8), the current $I_{L,A}$ through the LED light source 118 is substantially independent of the period change. The terminology "substantially" represents that the rectified voltage $V_{REC}$ or the output voltage $V_{OUT}$ may change with the change rate ∂; however, the change is restricted within a certain range so as not to cause the LED light source 118 to flicker.

In one embodiment, if the maximum value of the second change rate β is set below the predetermined change rate, for example, if β is set less than 5%, then $\beta^2$ in the right side of the equation (8) can be neglected. As such, the equation (8) can be approximately given by the equation (9):

$$\partial=2\beta \tag{9}$$

As shown in the equation (9), in one embodiment, the controller 104 can set the first change rate ∂ of the time period $T_{SW}$ proportional to the second change rate β of the time duration $T_{ON}$. More specifically, the controller 104 can set the first change rate ∂ to be two (2) times the second change rate β. When the maximum value of the change rate β is set below the predetermined change rate (e.g., less than 5%), a quotient of the time duration $T_{ON}$ squared and the time period $T_{SW}$ is substantially independent of the period change by this method of setting. However, as understood by a person skilled in the art, the controller 104 can set the ratio between ∂ and β to other values close to 2, for example, ∂=1.98*β, or ∂=2.02*β, as long as the setting of ∂ and β prevents the LED light source 118 from flickering.

Figure 1C:
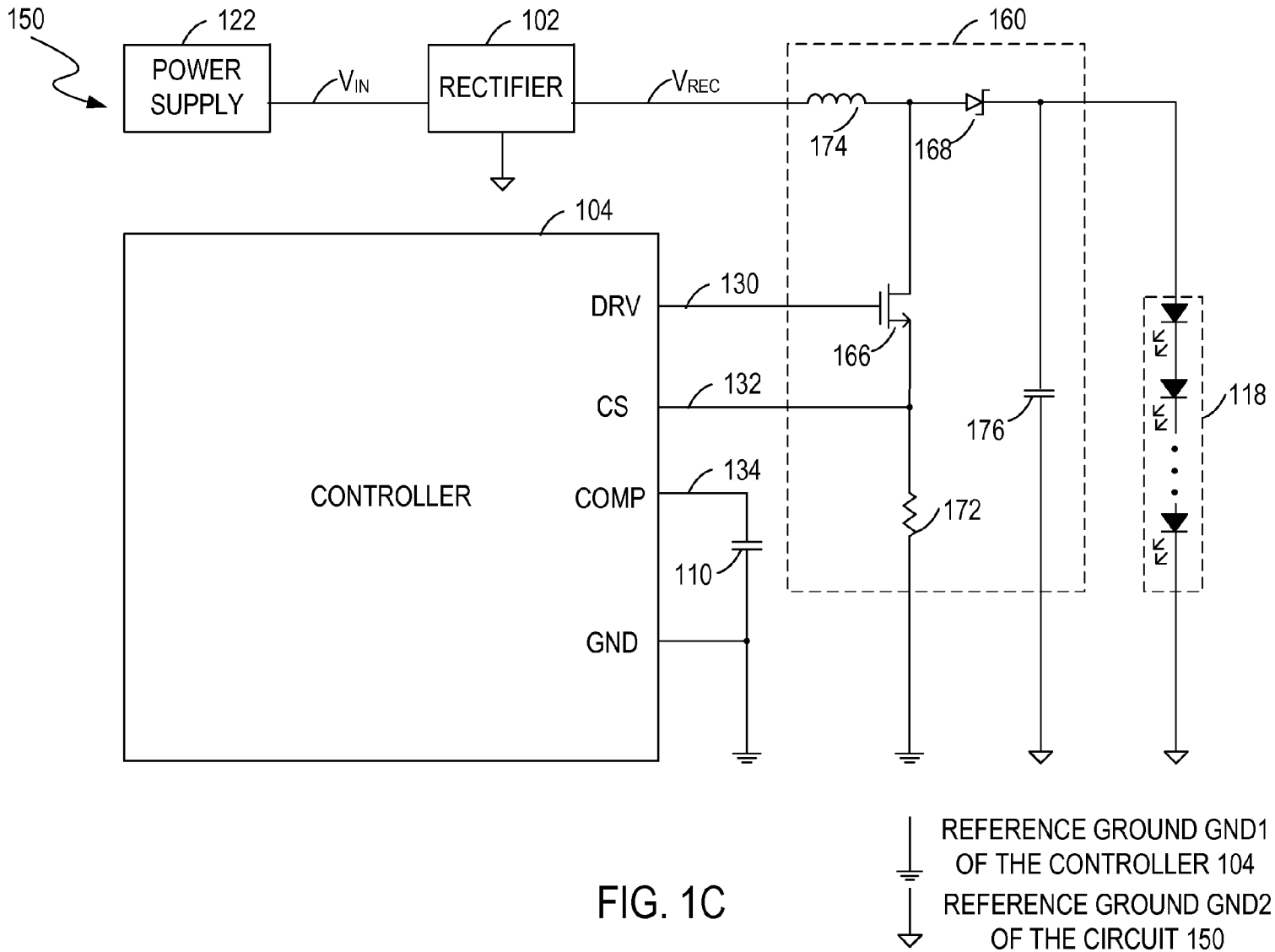
FIG. 1C illustrates a diagram of a driving circuit, in another embodiment according to the present invention.

FIG. 1C illustrates a block diagram of a driving circuit 150, in an embodiment according to the present invention. Elements labeled the same as in FIG. 1A have similar functions. FIG. 1C is described in combination with FIG. 1A. In the embodiment of FIG. 1C, a converter 160 is a boost converter. However, the converter 160 can have other configurations and is not limited to the example in FIG. 1A and FIG. 1C.

The driving circuit 150 includes the power supply 122, the rectifier 102, the controller 104, the converter 160, and the LED light source 118. In the embodiment of FIG. 1C, the converter 160 includes a switch 166, a diode 168, a resistor 172, an energy storage unit 174 (e.g. an inductor), and a capacitor 176. When the driving signal 130 has the first level (e.g., a high electrical level), the switch 166 is turned on. A current $I_L'$ flows through the inductor 174, the switch 166, and the resistor 172, to charge the inductor 174. The current $I_L'$ increases gradually. When the driving signal 130 has the second level (e.g., a low electrical level), the switch 166 is turned off. The inductor 174 is discharged and the current $I_L'$ then flows from the inductor 174 through the diode 168 to the LED light source 118. The current $I_L'$ decreases gradually. Similar to the description in FIG. 1A, the average current $I_{L,A}'$ flowing through the LED light source 118 can be given by the equation (10):

$$I_{L,A}' = 1/2^* I_{L,UP}'^* T_{DOWN}' / T_{SW}' \tag{10}$$

-continued $$= 1/(2L')^* V_{REC}^* T_{ON}'^* T_{DOWN}' / T_{SW}'$$

$$= 1/(2L')^* T_{ON}'^2 / T_{SW}'^* V_{REC}^2 / (V_{OUT} - V_{REC}).$$

Thus, the average current $I_{L,A}'$ flowing through the light source 118 is also a function of a quotient of the time duration $T_{ON}'$ squared and the time period $T_{SW}'$ ($T_{ON}'^2/T_{SW}'$). Advantageously, the controller 104 modulates the time period $T_{SW}'$ and the time duration $T_{ON}'$ of the driving signal 130 in a similar way, such that EMC of the driving circuit 150 is improved. The controller 104 further sets the change rates of the time duration $T_{ON}'$ and the time period $T_{SW}'$, such that a quotient of the time duration $T_{ON}'$ squared and the time period $T_{SW}'$ is substantially independent of the period change. Thus, the average current $I_{L,A}'$ flowing through the LED light source 118 is independent of the period change. Therefore, the stability of the driving circuit 150 is enhanced.

Figure 1D:
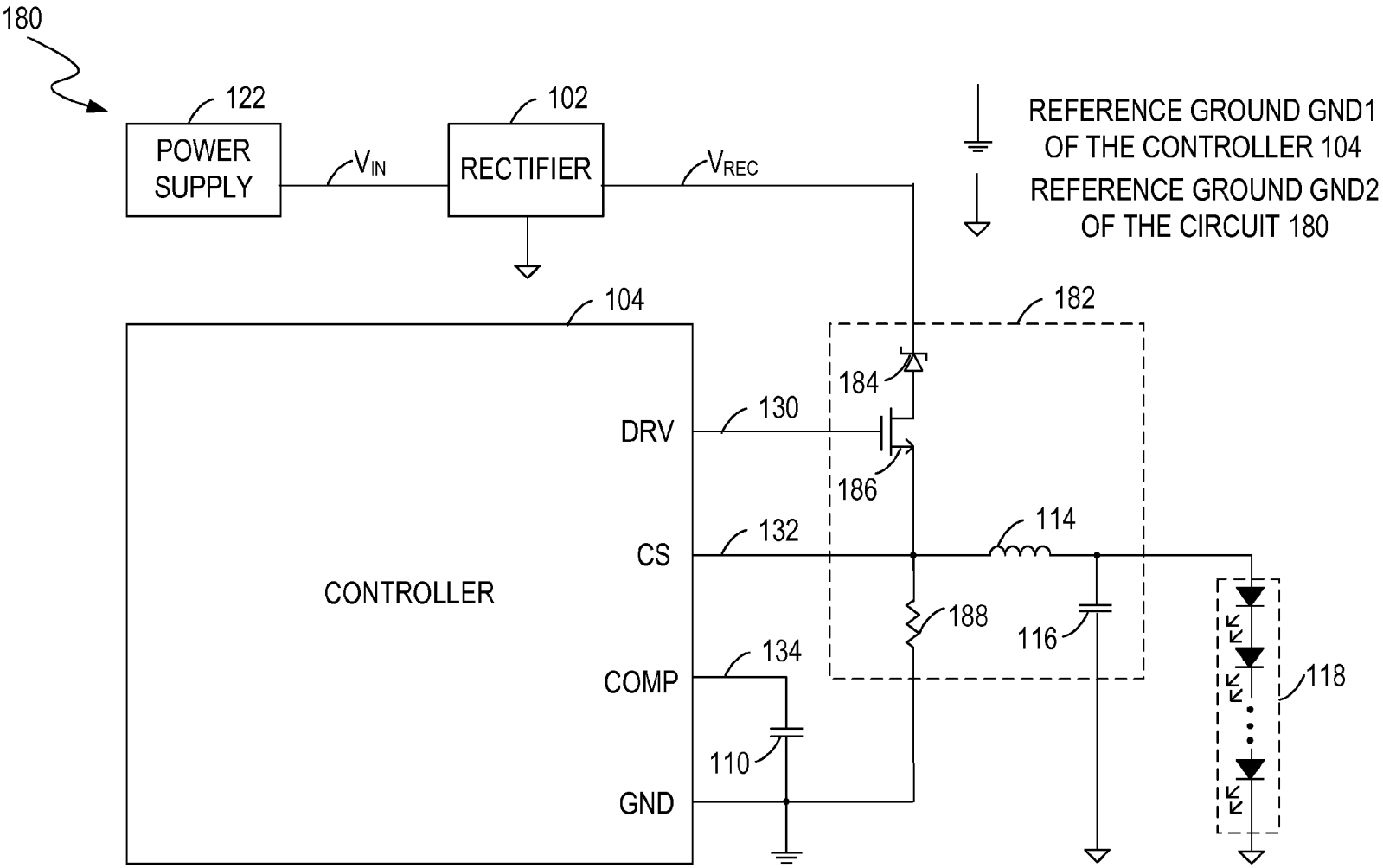
FIG. 1D illustrates a diagram of a driving circuit, in another embodiment according to the present invention.

FIG. 1D illustrates a block diagram of a driving circuit 180, in an embodiment according to the present invention. Elements labeled the same as in FIG. 1A have similar functions. In the embodiment of FIG. 1D, a converter 182 is a low-side buck converter including a diode 184, a switch 186, and a resistor 188 coupled in series, an energy storage unit 114 (e.g., an inductor), and a capacitor 116. However, the converter 182 can have other configurations and is not limited to the examples in FIG. 1A, FIG. 1C, and FIG. 1D. The driving circuit 180 in FIG. 1D operates similarly to the driving circuit 100 in FIG. 1A.

Figure 2A:
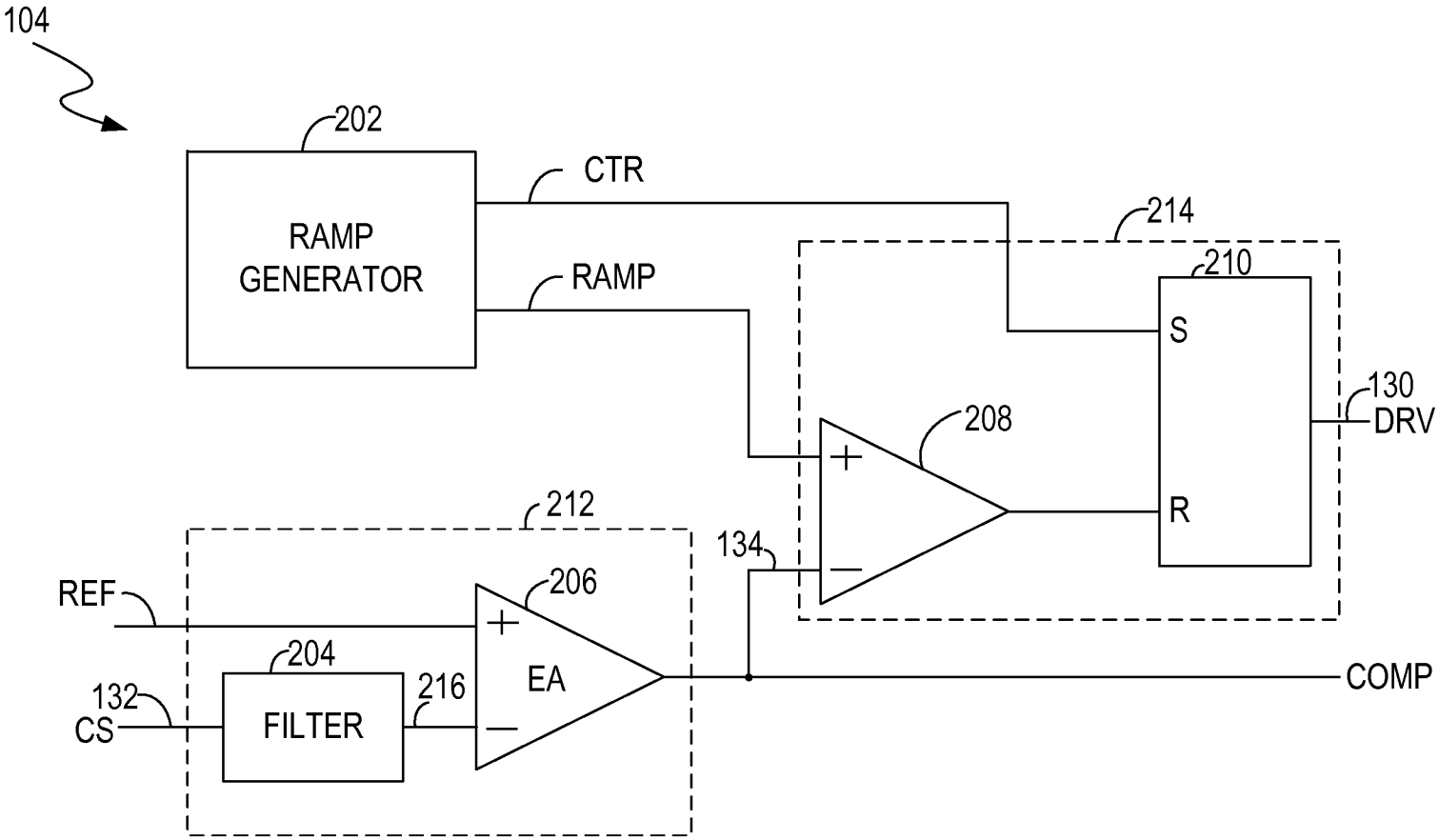
FIG. 2A illustrates a diagram of a controller, in an embodiment according to the present invention.

FIG. 2A illustrates a block diagram of the controller 104, in an embodiment according to the present invention. Elements labeled the same as in FIG. 1A have similar functions. FIG. 2A is described in combination with FIG. 1A and FIG. 1B.

In one embodiment, the controller 104 includes a ramp generator 202, a sensing circuit 212, and an output circuit 214. The sensing circuit 212 receives the sense signal 132 via the CS pin. The sense signal 132 indicates the current flowing through the LED light source 118. The sensing circuit 212 generates the reference signal 134 on the COMP pin according to the sense signal 132. The ramp generator 202 generates a ramp signal RAMP. In one embodiment, the ramp signal RAMP is a periodic signal, which rises from a valley value $V_N$ to a peak value $V_P$ and then falls from the peak value $V_P$ to the valley value $V_N$ per period. The ramp generator 202 further generates a control signal CTR. In one embodiment, the control signal CTR is a PWM signal, which has a third level (e.g., a high electrical level) when the ramp signal RAMP rises, and has a fourth level (e.g., a low electrical level) when the ramp signal RAMP falls. The output circuit 214 receives the reference signal 134 and the ramp signal RAMP, and accordingly generates the driving signal 130 on the DRV pin of the controller 104, so as to operate the switch 106 on and off alternately. In one embodiment, the ramp generator 202 regulates the rising rate and the falling rate of the ramp signal RAMP, so as to modulate the time period $T_{SW}$ and the time duration $T_{ON}$ of the driving signal 130. For example, the time period $T_{SW}$ of the driving signal 130 has a first change rate ∂, while the time duration $T_{ON}$ has a second change rate β. When the change rates ∂ and β satisfy either the equation (8) or (9), the current $I_{L,A}$ through the LED light source 118 is substantially independent of the period change. The operation of the ramp generator 202 is further described in FIG. 3.

In one embodiment, the sensing circuit 212 includes a filter 204 and an error amplifier 206. The filter 204 receives the sense signal 132 indicating a transient current $I_L$ flowing through the inductor 114, and filters the sense signal 132 to generate a filter signal 216. In one embodiment, the filter signal 216 indicates an average current $I_{L,A}$ flowing through the LED light source 118. The error amplifier 206 receives the filter signal 216 at the inverting input terminal, receives the reference signal REF indicating a desired current level for the average current $I_{L,A}$ at the non-inverting input terminal, and generates the reference signal 134 at the output terminal. In one embodiment, the reference signal 134 is determined by a difference between the reference signal REF and the filter signal 216.

The output circuit 214 includes a comparator 208 and a trigger 210. The comparator 208 compares the ramp signal RAMP with the reference signal 134. The trigger 210 generates the driving signal 130 according to the control signal CTR and a result of the comparison, so as to turn the switch 106 on and off alternately.

Figure 2B:
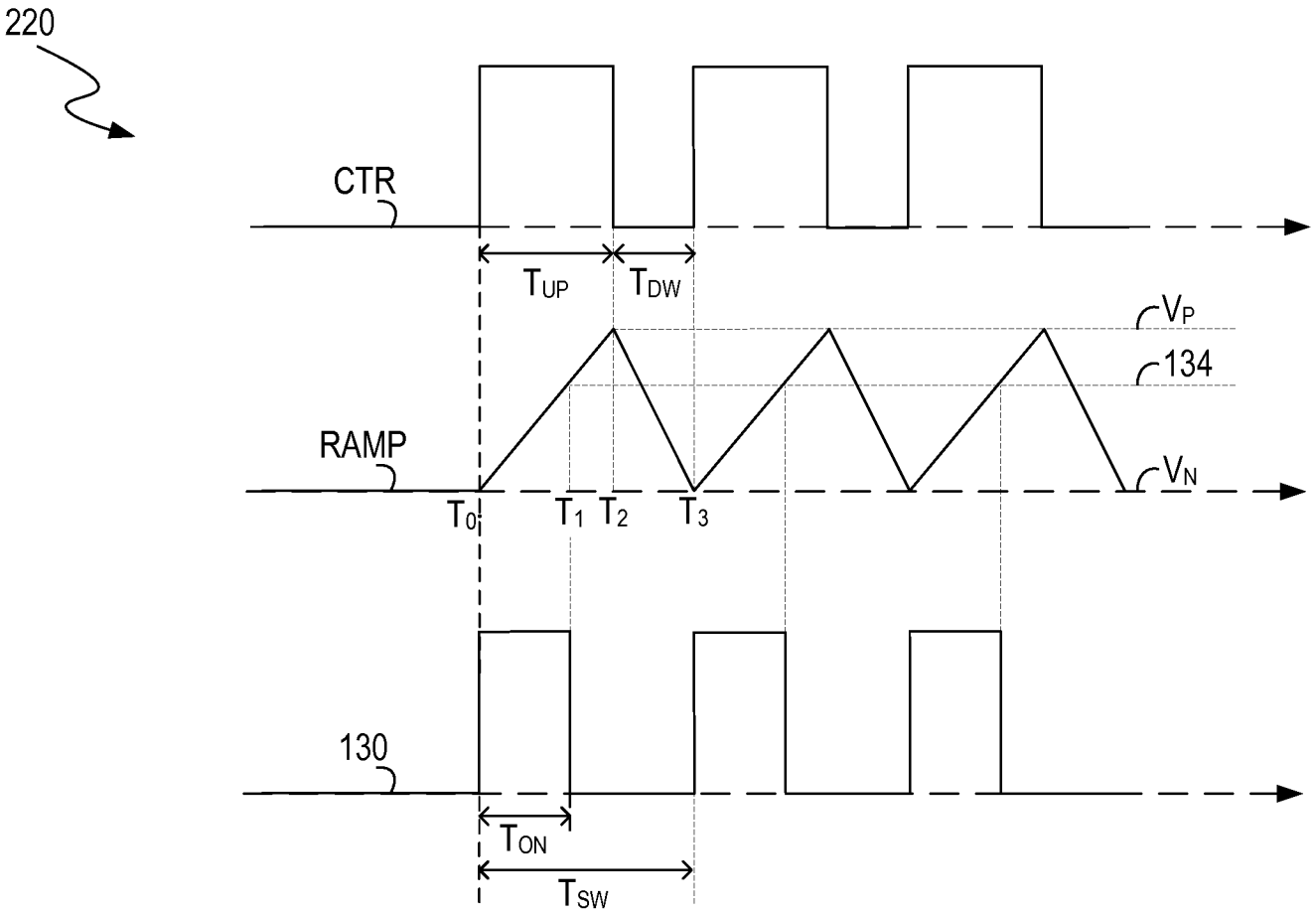
FIG. 2B illustrates waveforms of signals received or generated by an output circuit, in an embodiment according to the present invention.

FIG. 2B illustrates waveforms 220 of signals received or generated by the output circuit 214, in an embodiment according to the present invention. FIG. 2B is described in combination with FIG. 2A. FIG. 2B shows the control signal CTR, the ramp signal RAMP, and the driving signal 130.

In one embodiment, the output circuit 214 receives the reference signal 134, the ramp signal RAMP, and the control signal CTR. As shown in FIG. 2B, the control signal CTR is a PWM signal. During a rise time $T_{UP}$ from $T_0$ to $T_2$, the ramp signal RAMP ramps up, and the control signal CTR has a high level. During a fall time $T_{DW}$ from $T_2$ to $T_3$, the ramp signal RAMP ramps down, and the control signal CTR has a low level. More specifically, the ramp signal RAMP is equal to the valley value $V_N$ at time $T_0$, and the control signal CTR is then switched to a high level. From $T_0$ to $T_1$, the ramp signal RAMP rises from the valley value $V_N$ to an intermediate level which is equal to the reference signal 134. Since the ramp signal RAMP is less than the reference signal 134 and the control signal CTR has a high level, the driving signal 130 has the first level (e.g., a high level). From $T_1$ to $T_2$, the ramp signal RAMP rises from the intermediate level to the peak value $V_P$. Since the ramp signal RAMP is greater than the reference signal 134 and the control signal CTR has a high level, the driving signal 130 has the second level (e.g., a low level). At time $T_2$, the control signal CTR is switched to a low level when the ramp signal RAMP reaches the peak value V. From $T_2$ to $T_3$, the ramp signal RAMP falls from the peak value $V_P$ to the valley value $V_N$. Since the control signal CTR has a low level, the driving signal 130 maintains the second level (e.g., a low level). At time $T_3$, the controller 104 enters next period.

As shown in FIG. 2B, the time duration $T_{ON}$ of the driving signal 130 is equal to a time duration for the ramp signal RAMP to rise from the valley value $V_N$ to a level equal to the reference signal 134. Thus, a change rate of the rising rate of the ramp signal RAMP determines a change rate of the time duration $T_{ON}$. In one embodiment, by setting the change rate of the rise time $T_{UP}$ indicating the rising rate to β, the time duration $T_{ON}$ has a change rate of β. Furthermore, the time period $T_{SW}$ of the driving signal 130 is equal to a sum of the rise time $T_{UP}$ for the ramp signal RAMP to rise from the valley value $V_N$ to the peak value $V_P$ and the fall time $T_{DW}$ for the ramp signal RAMP to fall from the peak value $V_P$ to the valley value $V_N$. Thus, the change rate of the rising rate determines a change rate of the rise time $T_{UP}$, and a change rate of the falling rate determines a change rate of the fall time $T_{DW}$. In other words, both the change rates of the rising rate and of the falling rate determine a change rate of the time period $T_{SW}$. In one embodiment, the ramp signal RAMP has a time period equal to the time period $T_{SW}$ of the driving signal 130. By setting the change rate of time period of the ramp signal RAMP indicating the rising rate and the falling rate to 2β, the time period $T_{SW}$ has a change rate of 2β. Advantageously, the ramp generator 202 modulates the time period $T_{SW}$ and the rise time $T_{UP}$ of the ramp signal RAMP with a change rate of 2β and β, respectively, such that the time period $T_{SW}$ and the time duration $T_{ON}$ of the driving signal 130 have a change rate of 2β and β, respectively. Therefore, the output current is substantially independent of the period change.

Figure 3:
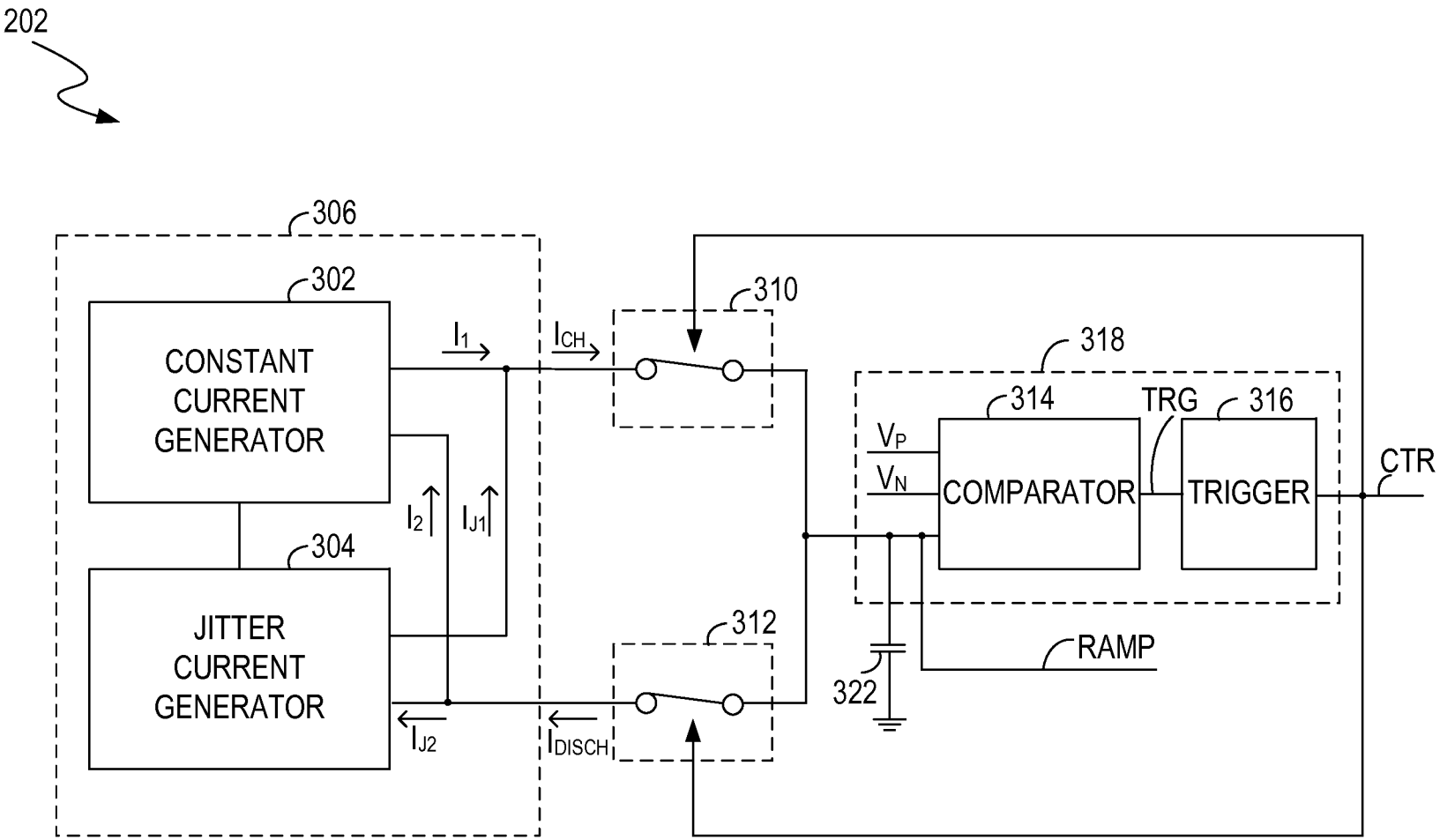
FIG. 3 illustrates a ramp generator, in an embodiment according to the present invention.

FIG. 3 illustrates a block diagram of the ramp generator 202, in an embodiment according to the present invention. FIG. 3 is described in combination with FIG. 2A and FIG. 2B.

In one embodiment, the ramp generator 202 includes a current generator 306, a switch 310, a switch 312, an energy storage unit 322 (e.g., a capacitor), and a control circuit 318. In one embodiment, the current generator 306 generates a charging current $I_{CH}$ and a discharging current $I_{DISCH}$. The switch 310 selectively conducts a current path for the charging current $I_{CH}$ according to the control signal CTR to charge the capacitor 322. The switch 312 selectively conducts a current path for the discharging current $I_{DISCH}$ according to the control signal CTR to discharge the capacitor 322. The capacitor 322 operates to provide the ramp signal RAMP. The control circuit 318 generates the control signal CTR according to the ramp signal RAMP, so as to control the conduction status of the switch 310 and 312.

More specifically, when the control signal CTR has a high level, the switch 312 is turned off and the switch 310 is turned on. As such, the charging current $I_{CH}$ flows to the capacitor 322 to charge the capacitor 322. The ramp signal RAMP then gradually rises from the valley value $V_N$ to the peak value $V_P$, with a rising rate determined by the charging current $I_{CH}$. When the control signal CTR has a low level, the switch 310 is turned off and the switch 312 is turned on. As such, the discharging current $I_{DISCH}$ flows from the capacitor 322 to discharge the capacitor 322. The ramp signal RAMP then gradually falls from the peak value $V_P$ to the valley value $V_N$, with a falling rate determined by the discharging current $I_{DISCH}$.

In one embodiment, the control circuit 318 includes a comparator 314 and a trigger 316. The comparator 314 compares the ramp signal RAMP and the peak value $V_P$, and compares the ramp signal RAMP and the valley value $V_N$. Based upon the results of two comparisons, the comparator 314 generates the trigger signal TRG. The trigger 316 generates the control signal CTR according to the trigger signal TRG. Combined with the description in FIG. 2B, when the ramp signal RAMP rises to the peak value $V_P$ (e.g., at time $T_2$), the trigger signal TRG has a fifth level (e.g., a low level) to reset the trigger 316, such that the control signal CTR is switched to a low level. Then, the capacitor 322 is discharged and accordingly the ramp signal RAMP drops down. When the ramp signal RAMP drops to the valley value $V_N$ (e.g., at time $T_3$), the trigger signal TRG has a sixth level (e.g., a high level) to set the trigger 316, such that the control signal CTR is switched to a high level. Then, the capacitor 322 is charged and accordingly the ramp signal RAMP rises.

In one embodiment, the current generator 306 regulates the charging current $I_{CH}$ and the discharging current $I_{DISCH}$ to modulate the time period $T_{SW}$ and the time duration $T_{ON}$ with a change rate according to the equation (8) or (9) in different periods. In the embodiment of FIG. 3, the current generator 306 includes a constant current generator 302 and a jitter current generator 304. The constant current generator 302 generates a first current $I_1$ and a second current $I_2$. The jitter current generator 304 generates a first jitter current $I_{J1}$ and a second jitter current $I_{J2}$. The ramp generator 202 (FIG. 2A) merges the first current $I_1$ and the first jitter current $I_{J1}$ to generate the charging current $I_{CH}$, and merges the second current $I_2$ and the second jitter current $I_{J2}$ to generate the discharging current $I_{DISCH}$. In one embodiment, the first current $I_1$ and the second current $I_2$ remain constant. However, the first jitter current $I_{J1}$ and the second jitter current $I_{J2}$ have different current levels in different periods of the driving signal 130, such that the charging current $I_{CH}$ and the discharging current $I_{DISCH}$ have different current levels in different periods. Accordingly, the rising rate and the falling rate of the ramp signal RAMP change. The operation of the jitter current generator 304 is further described in FIG. 4.

In one embodiment, according to the equation (9), in order to set the change rate of the time duration $T_{ON}$ and of the time period $T_{SW}$ to be β and 2β, respectively, the constant current generator 302 maintains a ratio between the second current $I_2$ and the first current $I_1$ at a first predetermined level k, e.g., $I_2=k*I_1$. Moreover, the jitter current generator 304 maintains a ratio between the second jitter current $I_{J2}$ and the first jitter current $I_{J1}$ at a second predetermined level a*k, e.g., $I_{J2}=a*k*I_{J1}$. In other words, when the ramp signal RAMP drops to the valley value $V_N$, the first current $I_1$ and the second current $I_2$ remain constant, and a ratio between the second current $I_2$ and the first current $I_1$ is the first predetermined level. Furthermore, the first jitter current $I_{J1}$ and the second jitter current $I_{J2}$ change, but a ratio between the second jitter current $I_{J2}$ and the first jitter current $I_{J1}$ remains constant. For example, the first jitter current $I_{J1}$ is regulated from $I_{J1_1}$ to $I_{J1_2}$, and the second jitter current $I_{J2}$ is regulated from $I_{J2_1}$ to $I_{J2_2}$, where a ratio between $I_{J2_1}$ and $I_{J1_1}$ is equal to a ratio between $I_{J2_2}$ and $I_{J1_2}$, and further equal to the second predetermined level.

The predetermined levels a and k are set as further described below. Specifically, in the following examples, the setting of the predetermined levels is conducted under the condition that the first jitter current $I_{J1}$ and the second jitter current $I_{J2}$ are modulated within a relatively small range (e.g., the change rate β is less than 5%). Thus, based upon linear approximation principle of Taylor Series, the expression 1/(1+β) with a variable of β can be represented by 1−β with a linear approximation. Similarly, the expression 1+2β can be represented by 1/(1−2β).

In one embodiment, the charging current $I_{CH}$ determines the rising rate of the ramp signal RAMP. More specifically, the charging current $I_{CH}$ is inversely proportional to the rise time $T_{UP}$ of the ramp signal RAMP. When the change rate of the rise time $T_{UP}$ is set to β (such that the time duration $T_{ON}$ is set to have a change rate β), the charging current $I_{CH}$ can be represented by $I_{CH}=I_{CH,M}/(1+\beta)$. According to the linear approximation principle, the charging current $I_{CH}$ can be further represented by $I_{CH}=I_{CH,M}*(1-\beta)$. In other words, the charging current $I_{CH}$ has an approximate change rate of −β. Thus, if β is set to a relatively small value, the rise time $T_{UP}$ has a change rate of β by setting the charging current $I_{CH}$ with a change rate of −β, such that the change rate of the time duration $T_{ON}$ is equal to β. By way of example, if the charging current $I_{CH}$ drops 0.5% relative to the last period in one period, it can be approximated that the time duration $T_{ON}$ grows 0.5% relative to the last period.

More specifically, the charging current $I_{CH}$ equals a sum of the first current $I_1$ and the first jitter current $I_{J1}$, where the first current $I_1$ has a constant current value and the first jitter current $I_{J1}$ determines the change rate of the charging current $I_{CH}$. In one embodiment, by setting the first jitter current $I_{J1}$ equal to the first current $I_1$ multiplied by the change rate −β, e.g., $I_{J1}=(-\beta)*I_1$, the charging current $I_{CH}$ has a change rate of −β. Specifically, when the change rate β has a positive value, it indicates that the directions of the first jitter current $I_{J1}$ and the first current $I_1$ are opposite, that is, the charging current $I_{CH}$ is less than the first current $I_1$. When the change rate β has a negative value, it indicates that the directions of the first jitter current $I_{J1}$ and the first current $I_1$ are the same, that is, the charging current $I_{CH}$ is greater than the first current $I_1$. Therefore, the charging current $I_{CH}$ can be given by the equation (11):

$$I_{CH}=I_1+I_{J1}=I_1*(1-\beta). \tag{11}$$

Similarly, the discharging current $I_{DISCH}$ can be given by the equation (12):

$$I_{DISCH}=I_2+I_{J2}=k*I_1*(1-a*\beta). \tag{12}$$

It is described as followings how to set the predetermined levels a and k to make the time period $T_{SW}$ have a change rate of 2β.

As described in FIG. 2B, both the rise time $T_{UP}$ and the fall time $T_{DW}$ of the ramp signal RAMP determine the time period $T_{SW}$ of the ramp signal RAMP. The time period $T_{SW}$ can be given by the equation (13):

$$T_{SW}=T_{UP}+T_{DW}=(V_P-V_N)*(C/I_{CH}+C/I_{DISCH}), \tag{13}$$

where C represents the capacitance of the capacitor 322. By substituting the equation (11) and (12) into (13), then the time period $T_{SW}$ can be further given by the equation (14):

$$T_{SW}=(V_P-V_N)C\left(\frac{1-\frac{ak+1}{1+k}\beta}{\frac{KI_1}{1+k}[1-(1+a)\beta+a\beta^2]}\right). \tag{14}$$

If the basic time period of the driving signal 130 is preset when the jitter currents $I_{J1}$ and $I_{J2}$ are equal to zero, the basic time period $T_{SW,M}$ can be represented by $$T_{SW,M}=(V_P-V_N)C\left(\frac{1+k}{KI_1}\right),$$

such that the subsequent time periods can be expressed by $$T_{SW}=T_{SW,M}*\left(\frac{1-\frac{ak+1}{1+k}\beta}{1-(1+a)\beta+a\beta^2}\right).$$

Since the time period $T_{SW}$ has a change rate of 2β relative to $T_{SW,M}$, the time period $T_{SW}$ can be represented by $T_{SW}=T_{SW,M}*(1+2\beta)$. According to the linear approximation principle, the time period $T_{SW}$ can be further expressed by $T_{SW}=T_{SW,M}/(1-2\beta)$. As such, it can be given in the equation (15):

$$\frac{1}{1-2\beta}=\frac{1-\frac{ak+1}{1+k}\beta}{\frac{kI_1}{1+k}[1-(1+a)\beta+a\beta^2]}, \tag{15}$$

After simplification, it can be given in the equation (16):

$$1-\left(\frac{ak+1}{1+k}+2\right)\beta+2*\frac{ak+1}{1+k}\beta^2=1-(1+a)\beta+a\beta^2, \tag{16}$$

When the change rate β is modulated within a relatively small range (e.g., β is less than 5%), $\beta^2$ in the right side of the equation (16) can be neglected. The coefficient of β in the left side of the equation is equal to that in the right side, that is, $$\frac{ak+1}{1+k}+2=1+a.$$

Thus, a=k+2. For example, in one embodiment, a is set to 6 while k is set to 4. In other words, when the constant current generator 302 maintains the ratio between the second current $I_2$ and the first current $I_1$ at 4, and the jitter current generator 304 maintains the ratio between the second jitter current $I_{J2}$ and the first jitter current $I_{J1}$ at 24, the change rate of the time period $T_{SW}$ of the driving signal 130 is substantially two times of that of the time duration $T_{ON}$; that is, the equation (9) is satisfied. However, as understood by a person skilled in the art, a and k can be set to other values according to the equation (16).

Therefore, in the embodiment of FIG. 3, when the current generator 306 sets the charging current $I_{CH}$ to have a change rate of −β, the change rate of the time duration $T_{ON}$ can be approximately set to β. In the meanwhile, in subsequent periods, the current generator 306 maintains the ratio between the second current $I_2$ and the first current $I_1$ at the first determined level k, and also maintains the ratio between the second jitter current $I_{J2}$ and the first jitter current $I_{J1}$ at the second determined level a*k, where a and k are set in relation to the equation (16). Thus, in any subsequent period, the time period $T_{SW}$ has an approximate change rate of 2β. As described in FIG. 2A (as shown in the equation (9)), the output current flowing through the LED light source 118 is substantially independent of the period change, accordingly.

Figure 4:
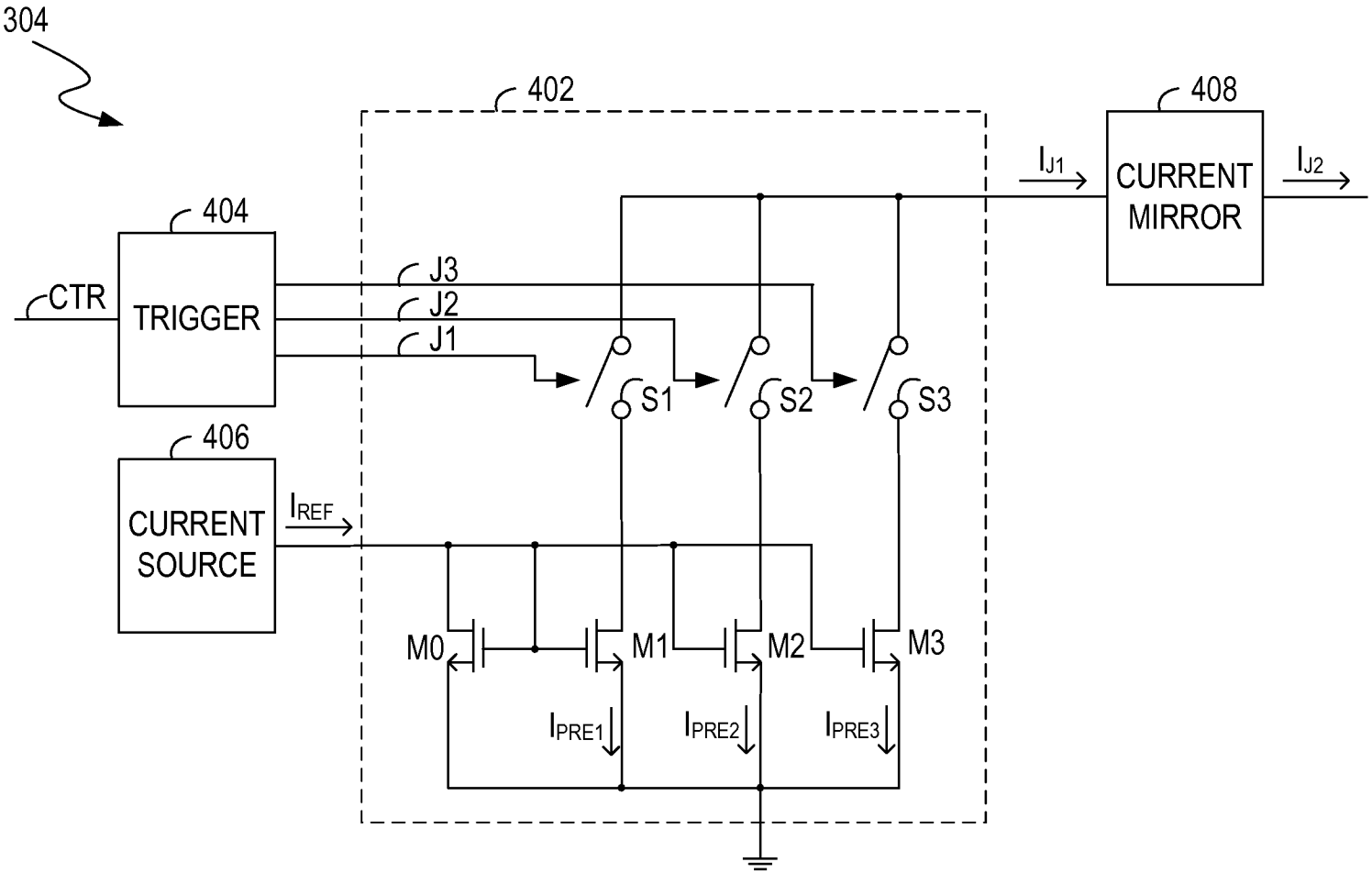
FIG. 4 illustrates a jitter generator, in an embodiment according to the present invention.

FIG. 4 illustrates a diagram of the jitter current generator 304, in an embodiment according to the present invention. FIG. 4 is described in combination with FIG. 3. In the embodiment of FIG. 4, the change rate β makes regular changes in different periods of the driving signal 130.

In one embodiment, the jitter current generator 304 includes a jitter generating module 402, a trigger 404, a current source 406 and a current mirror 408. In one embodiment, the trigger 404 includes multiple D-triggers coupled in series. The trigger 404 receives the control signal CTR, and generates the jitter signals J1, J2 and J3 accordingly. How the trigger 404 generates the jitter signals J1, J2 and J3 according to the control signal CTR is further described in FIG. 5. The current source 406 generates a reference current $I_{REF}$ indicating the first current $I_1$. The jitter generating module 402 receives the reference current $I_{REF}$, and generates the first jitter current $I_{J1}$ according to the jitter signals J1, J2 and J3. The current mirror 408 receives the first jitter current $I_{J1}$, and accordingly generates the second jitter current $I_{J2}$. The current mirror 408 maintains a ratio between $I_{J2}$ and $I_{J1}$ at the second predetermined level a*k.

In one embodiment, the jitter generating module 402 includes transistors M0 to M3 coupled in parallel, and switches S1 to S3 coupled in series to the transistors M1 to M3. The transistors M1 to M3 constitute multiple current mirrors with M0, respectively, for generating the current $I_{PRE1}$, $I_{PRE2}$, and $I_{PRE3}$. The conductance status of the switches S1 to S3 is controlled by the jitter signals J1 to J3, such that the first jitter current $I_{J1}$ is generated accordingly. Take the switch S1 for example, if J1 has a high level (represented by logic 1), the switch S1 is turned on; if J1 has a low level (represented by logic 0), the switch S1 is turned off. The switches S2 and S3 operate similarly as S1.

Figure 5:
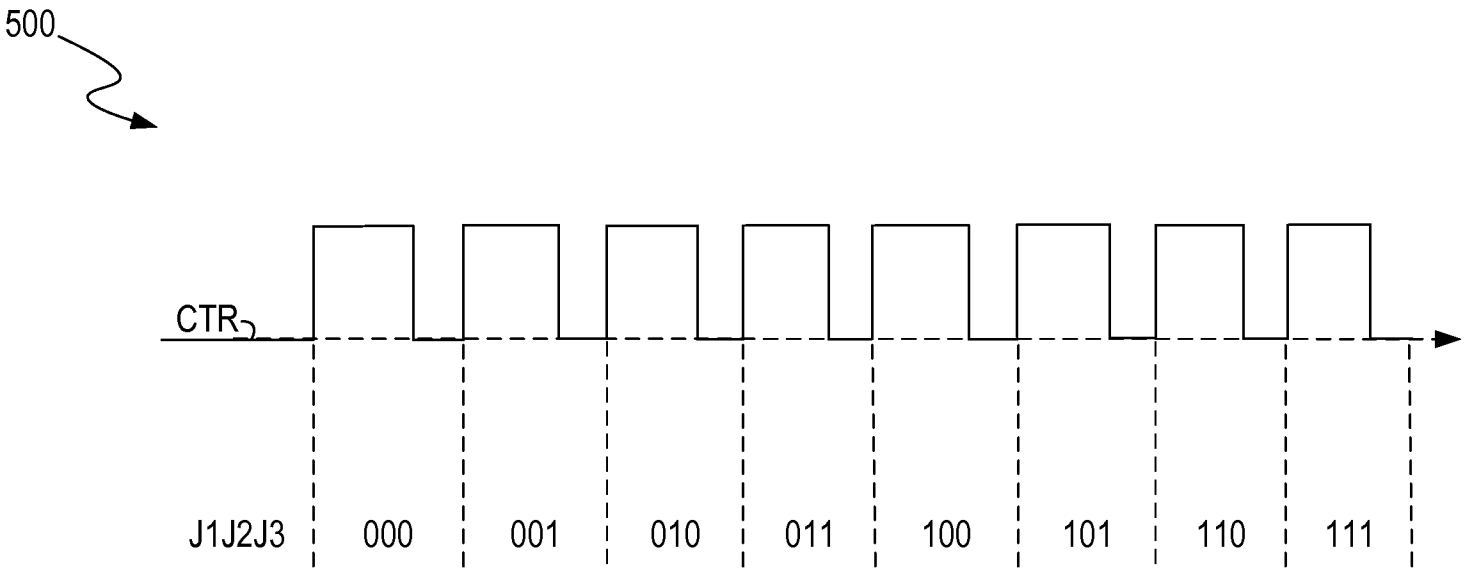
FIG. 5 illustrates waveforms of signals received or generated by a trigger, in an embodiment according to the present invention.

FIG. 5 illustrates waveforms 500 of signals received or generated by the trigger 404, in an embodiment according to the present invention. FIG. 5 is described in combination with FIG. 4. FIG. 5 shows the control signal CTR, and the jitter signals J1, J2, and J3. FIG. 5 describes how the trigger 404 generates the jitter signals J1, J2, and J3 according to the control signal CTR.

In the embodiment of FIG. 5, the jitter signals J1, J2, and J3 are represented by logic signals. For example, logic 1 corresponds to a high level of the corresponding signal, while logic 0 corresponds to a low level of the corresponding signal. In one embodiment, the jitter signals J1, J2, and J3 are switched according to the control signal CTR. Specifically, in one embodiment, the jitter signals J1, J2, and J3 are triggered by the rising edges of the control signal CTR. With the jitter signals J1, J2, and J3 represented as a binary number J1J2J3, as shown in FIG. 5, every rising edge of the control signal CTR triggers the addition of 1 to the binary number. More specifically, J1J2J3 increases progressively from 000 to 001, 010, 011, 100, 101, 110, and 111 in subsequent periods, and so on.

In one embodiment, the relationship between the first jitter current $I_{J1}$ and the jitter signals J1, J2, and J3 is illustrated in Table 3.

TABLE 3

| J1J2J3 | $I_{J1}$ |
|---|---|
| 000 | 0 |
| 001 | $I_{PRE3}$ |
| 010 | $I_{PRE2}$ |
| 011 | $I_{PRE3}+I_{PRE2}$ |
| 100 | $I_{PRE1}$ |
| 101 | $I_{PRE3}+I_{PRE1}$ |
| 110 | $I_{PRE2}+I_{PRE1}$ |
| 111 | $I_{PRE3}+I_{PRE2}+I_{PRE1}$ |

As described in FIG. 4, for the transistor M1, when the jitter signal J1 is logic 1, the switch S1 is turned on to conduct the current $I_{PRE1}$; when the jitter signal J1 is logic 0, the switch S1 is turned off to cut off the current $I_{PRE1}$. Other switches operate similarly. Thus, according to FIG. 5, the binary value J1J2J3 has eight (8) different states in 8 adjacent periods. As such, the switches S1, S2, and S3 have 8 conductance statuses. Accordingly, the first jitter current $I_{J1}$ has 8 different current levels in these 8 adjacent periods. More specifically, when J1J2J3 has a value of 000, 001, 010, 011, 100, 101, 110, and 111, the first jitter current $I_{J1}$ is equal to 0, $I_{PRE3}$, $I_{PRE2}$, $I_{PRE2}+I_{PRE3}$, $I_{PRE1}$, $I_{PRE1}+I_{PRE3}$, $I_{PRE1}+I_{PRE2}$, and $I_{PRE1}+I_{PRE2}+I_{PRE3}$, respectively. In one embodiment, the setting of the currents $I_{PRE1}$, $I_{PRE2}$, and $I_{PRE3}$ satisfies $I_{PRE1}>I_{PRE2}+I_{PRE3}>I_{PRE2}>I_{PRE3}$, e.g., $I_{PRE1}$=4uA, $I_{PRE2}$=2uA, and $I_{PRE3}$=1uA. Thus, the first jitter current $I_{J1}$ increases in these 8 periods.

However, the present invention is not limited to the embodiments shown in FIG. 4 to FIG. 5. In another embodiment, the trigger 404 is triggered to decrease progressively. In other words, J1J2J3 can be equal to 111, 110, 101, 100, 011, 010, 001, and 000 in 8 adjacent periods. Thus, the first jitter current $I_{J1}$ gradually decreases. In yet another embodiment, the trigger 404 can be replaced by a random generator. When a rising edge of the control signal CTR is detected, the random generator generates the jitter signals J1, J2, and J3 randomly. In this situation, the first jitter current $I_{J1}$ can either increase or decrease progressively in different periods.

Figure 6:
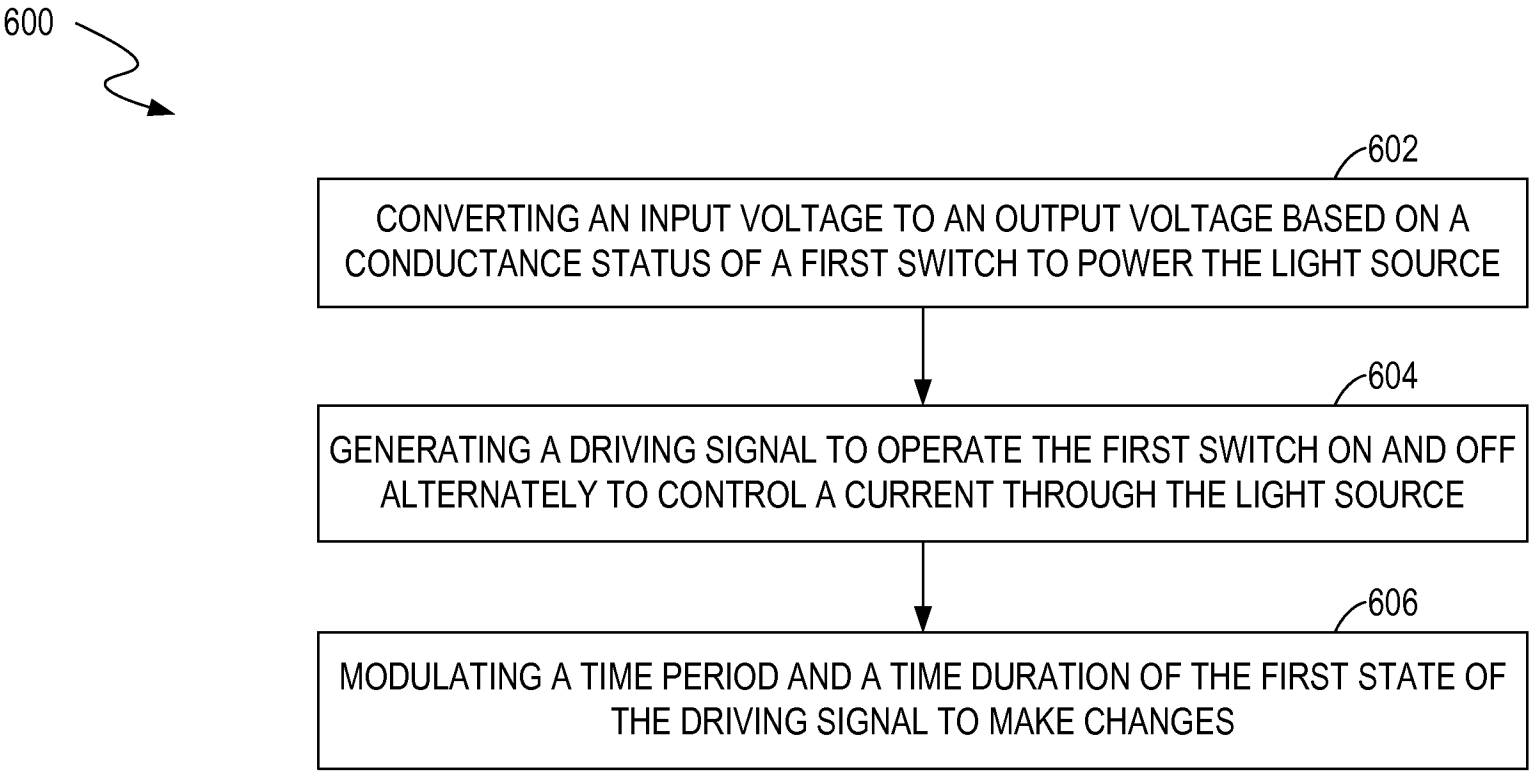
FIG. 6 illustrates a flowchart of examples of operations by a circuit for driving an LED light source, in an embodiment according to the present invention.

FIG. 6 illustrates a flowchart 600 of examples of operations performed by a circuit for driving an LED light source, e.g., the circuit 100, 150, or 180. FIG. 6 is described in combination with FIG. 1A to FIG. 5B. Although specific steps are disclosed in FIG. 6, such steps are examples. That is, the present invention is well suited to performing various other steps or variations of the steps recited in FIG. 6.

In block 602, an input voltage (e.g., the rectified voltage $V_{REC}$) is converted to an output voltage (e.g., the output voltage $V_{OUT}$) based on a conductance status of a first switch (e.g., the switch 106) to power the light source (e.g., the LED light source 118).

In block 604, a driving signal (e.g., the driving signal 130) is generated to operate the first switch on and off alternately to control a current through the light source. In one embodiment, the driving signal is a periodic signal having a first state (e.g., a high level) and a second state (e.g., a low level) in a period. The first switch is turned on when the driving signal operates in the first state, and is turned off when the driving signal operates in the second state. In one embodiment, a reference signal (e.g., the reference signal 134) is received. A ramp signal (e.g., the ramp signal RAMP) is generated, which ramps up and down periodically. The driving signal is generated according to the reference signal and the ramp signal. Specifically, the period of the driving signal includes a first time duration and a second time duration. The ramp signal rises from a valley value (e.g., the valley value $V_N$) to an intermediate value equal to the reference signal during the first time duration, and rises from the intermediate value to a peak value (e.g., the peak value $V_P$) and then falls from the peak value to the valley value during the second time duration. The driving signal operates in the first state during the first time duration and operates in the second state during the second time duration.

In one embodiment, the ramp signal is compared with a first threshold (e.g., the voltage $V_P$), and is compared with a second threshold (e.g., the voltage $V_N$). A discharging current (e.g., the current $I_{DISCH}$) is conducted to discharge a capacitor (e.g., the capacitor 322) when the ramp signal rises to the first threshold, then the ramp signal ramps down. A charging current (e.g., the current $I_{CH}$) is conducted to charge the capacitor when the ramp signal falls to the second threshold, then the ramp signal ramps up. In one embodiment, a first current (e.g., the current $I_1$) and a first jitter current (e.g., the current $I_{J1}$) are merged to generate the charging current. A second current (e.g., the current $I_2$) and a second jitter current (e.g., the current $I_{J2}$) are merged to generate the discharging current. The second current is proportional to the first current, and the second jitter current is proportional to the first jitter current.

In block 606, a time period (e.g., the time period $T_{SW}$) of the driving signal and a time duration (e.g., the time duration $T_{ON}$) of the first state are modulated, such that a quotient of the time duration squared and the time period is substantially independent of a change of the time period in each period of the driving signal, and the current is substantially independent of the change. In one embodiment, a change rate $\partial$ of the time period and a change rate $\beta$ of the time duration satisfy $1+\partial=(1+\beta)^2$. In another embodiment, a change rate of the time period is proportional to a change rate of the time duration. Specifically, the change rate of the time period is two times the change rate of the time duration.

In one embodiment, a rising rate and a falling rate of the ramp signal are regulated to control the time period and the time duration. In one embodiment, the first current and the second current are maintained constant, where a ratio between the second current and the first current is equal to a first predetermined level. The first jitter current and the second jitter current are regulated when the ramp signal drops to the second threshold, where a ratio between the second jitter current and the first jitter current is maintained equal to a second predetermined level, such that the quotient between the time duration squared and the time period is substantially independent of the period change.

While the foregoing description and drawings represent embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. A driving circuit for powering a light-emitting diode (LED) light source, said driving circuit comprising:

a converter, configured to provide an output voltage to power said light source; said converter comprising a first switch, wherein said first switch is turned on and off alternately according to a driving signal to control a current through said light source; and a controller coupled to said converter and configured to generate said driving signal, wherein said driving signal is a periodic signal having a first state and a second state per time period; wherein said first switch is turned on when said driving signal operates in said first state, and is turned off when said driving signal operates in said second state, wherein said controller modulates a time period of said driving signal and a time duration of said first state, such that a quotient of said time duration squared and said time period is substantially independent of a change of said time period, and said current is substantially independent of said change.

2. The circuit as claimed in claim 1, wherein a change rate $\partial$ of said time period and a change rate $\beta$ of said time duration satisfy $1+\partial=(1+\beta)^2$.

3. The circuit as claimed in claim 1, wherein a change rate of said time period is proportional to a change rate of said time duration.

4. The circuit as claimed in claim 3, wherein said change rate of said time period is two times said change rate of said time duration.

5. The circuit as claimed in claim 1, wherein said controller comprises:

a sensing circuit, configured to receive a sense signal indicating said current through said light source, and to generate reference signal according to said sense signal;

a ramp generator, configured to generate a ramp signal, wherein said ramp signal ramps up and down periodically; and an output circuit, configured to generate said driving signal according to said reference signal and said ramp signal, wherein said ramp generator regulates a rising rate and a falling rate of said ramp signal to modulate said time period and said time duration.

6. The circuit as claimed in claim 5, wherein said time period of said driving signal comprises a first time duration and a second time duration, wherein said ramp signal rises from a valley value to an intermediate value equal to said reference signal during said first time duration and rises from said intermediate value to a peak value and then falls from said peak value to said valley value during said second time duration, wherein said driving signal operates in said first state during said first time duration and operates in said second state during said second time duration.

7. The circuit as claimed in claim 5, wherein a change rate of said rising rate determines said change rate of said time duration, and wherein both said change rate of said rising rate and a change rate of said falling rate determine said change rate of said time period.

8. The circuit as claimed in claim 5, wherein said ramp generator comprises:

an energy storage unit, configured to provide said ramp signal; and a control circuit, configured to compare said ramp signal and a first threshold, and to compare said ramp signal and a second threshold, wherein said control circuit conducts a discharging current to discharge said energy storage unit when said ramp signal rises to said first threshold, such that said ramp signal ramps down, and wherein said control circuit conducts a charging current to charge said energy storage unit when said ramp signal falls to said second threshold, such that said ramp signal ramps up.

9. The circuit as claimed in claim 8, wherein said ramp generator further comprises:

a current generator coupled to said control circuit and configured to generate a first current, a second current, a first jitter current, and a second jitter current, wherein said current generator merges said first current and said first jitter current to generate said charging current, and merges said second current and said second jitter current to generate said discharging current, and wherein said first jitter current and said second jitter current have different current levels during different time periods of said driving signal, such that said rising rate and said falling rate of said ramp signal change said time period.

10. The circuit as claimed in claim 9, wherein said current generator maintains a ratio between said second current and said first current equal to a first predetermined level, and maintains a ratio between said second jitter current and said first jitter current equal to a second predetermined level, such that said quotient between said time duration squared and said time period is substantially independent of said change.

11. A controller for controlling power to a light-emitting diode (LED) light source, said controller comprising:

a ramp generator, configured to generate a ramp signal, wherein said ramp signal ramps up and down periodically; and an output circuit coupled to said ramp generator and configured to generate a driving signal according to said ramp signal, wherein a first switch coupled to said controller is turned on and off alternately according to said driving signal to regulate a current through said light source, wherein said driving signal is a periodic signal having a first state and a second state per time period, wherein said first switch is turned on when said driving signal operates in said first state and is turned off when said driving signal operates in said second state, wherein said controller regulates a rising rate and a falling rate of said ramp signal to modulate a time period of said driving signal and a time duration of said first state, such that a quotient of said time duration squared and said time period is substantially independent of a change of said time period, and said current is substantially independent of said change.

12. The controller as claimed in claim 11, wherein a change rate $\partial$ of said time period and a change rate $\beta$ of said time duration satisfy $1+\partial=(1+\beta)^2$.

13. The controller as claimed in claim 11, wherein a change rate of said time period is proportional to a change rate of said time duration.

14. The controller as claimed in claim 13, wherein said change rate of said time period is two times said change rate of said time duration.

15. The controller as claimed in claim 11, wherein said controller further comprises:

a sensing circuit, configured to receive a sense signal indicating said current through said light source and to generate a reference signal according to said sense signal, wherein said output circuit compares said reference signal and said ramp signal to generate said driving signal, wherein said time period of said driving signal comprises a first time duration and a second time duration, wherein said ramp signal rises from a valley value to an intermediate value equal to said reference signal during said first time duration and rises from said intermediate value to a peak value and then falls from said peak value to said valley value during said second time duration, wherein said driving signal operates in said first state during said first time duration and operates in said second state during said second time duration.

16. The controller as claimed in claim 11, wherein said ramp generator comprises:

an energy storage unit, configured to provide said ramp signal; and a control circuit, configured to compare said ramp signal and a first threshold and to compare said ramp signal and a second threshold, wherein said control circuit conducts a discharging current to discharge said energy storage unit when said ramp signal rises to said first threshold, such that said ramp signal ramps down, and wherein said control circuit conducts a charging current to charge said energy storage unit when said ramp signal falls to said second threshold, such that said ramp signal ramps up.

17. The controller as claimed in claim 16, wherein said ramp generator further comprises:

a current generator coupled to said control circuit and configured to generate a first current, a second current, a first jitter current, and a second jitter current, wherein said current generator merges said first current and said first jitter current to generate said charging current and merges said second current and said second jitter current to generate said discharging current, and wherein said first jitter current and said second jitter current have different current levels during different time periods of said driving signal, such that said rising rate and said falling rate of said ramp signal change said time period.

18. The controller as claimed in claim 17, wherein said current generator maintains a ratio between said second current and said first current equal to a first predetermined level and maintains a ratio between said second jitter current and said first jitter current equal to a second predetermined level, such that said quotient between said time duration squared and said time period is substantially independent of said change.

19. A method for controlling power to a light-emitting diode (LED) light source, said method comprising:

converting an input voltage to an output voltage based on a conductance status of a first switch to power said light source;

generating a driving signal to operate said first switch on and off alternately to control a current through said light source, wherein said driving signal is a periodic signal having a first state and a second state per time period, said first switch is turned on when said driving signal operates in said first state, and is turned off when said driving signal operates in said second state; and modulating a time period of said driving signal and a time duration of said first state, such that a quotient of said time duration squared and said time period is substantially independent of a change of said time period, and said current is substantially independent of said change.

20. The method as claimed in claim 19, wherein a change rate $\partial$ of said time period and a change rate $\beta$ of said time duration satisfy $1+\partial=(1+\beta)^2$.

21. The method as claimed in claim 19, wherein a change rate of said time period is proportional to a change rate of said time duration.

22. The method as claimed in claim 21, wherein said change rate of said time period is two times said change rate of said time duration.

23. The method as claimed in claim 19, wherein said method further comprises:

receiving a reference signal;

generating a ramp signal, wherein said ramp signal ramps up and down periodically;

generating said driving signal according to said reference signal and said ramp signal, wherein said time period of said driving signal comprises a first time duration and a second time duration, wherein said ramp signal rises from a valley value to an intermediate value equal to said reference signal during said first time duration and rises from said intermediate value to a peak value and then falls from said peak value to said valley value during said second time duration, wherein said driving signal operates in said first state during said first time duration and operates in said second state during said second time duration; and regulating a rising rate and a falling rate of said ramp signal to control said time period and said time duration to change said time period.

24. The method as claimed in claim 23, wherein said method further comprises:

comparing said ramp signal and a first threshold;

comparing said ramp signal and a second threshold;

conducting a discharging current to discharge a capacitor when said ramp signal rises to said first threshold, wherein in response said ramp signal ramps down; and conducting a charging current to charge said capacitor when said ramp signal falls to said second threshold, wherein in response said ramp signal ramps up.

25. The method as claimed in claim 24, wherein said method further comprises:

merging a first current and a first jitter current to generate said charging current; and merging a second current and a second jitter current to generate said discharging current, wherein said second current is proportional to said first current, and said second jitter current is proportional to said first jitter current.

26. The method as claimed in claim 25, wherein said method further comprises:

maintaining said first current and said second current constant, wherein a ratio between said second current and said first current is equal to a first predetermined level; and regulating said first jitter current and said second jitter current when said ramp signal drops to said second threshold, wherein a ratio between said second jitter current and said first jitter current is maintained equal to a second predetermined level, such that said quotient between said time duration squared and said time period is substantially independent of said change.

* * * * *